United States Patent [19]

Haney et al.

[11] Patent Number: 4,815,546

[45] Date of Patent: Mar. 28, 1989

[54] TOP HEAD DRIVE ASSEMBLY WITH AXIALLY MOVABLE QUILL

[75] Inventors: Keith M. Haney; Clyde A. Willis, both of Wichita Falls, Tex.

[73] Assignee: W-N Apache Corporation, Wichita Falls, Tex.

[21] Appl. No.: 34,483

[22] Filed: Apr. 2, 1987

[51] Int. Cl.[4] ..... E21C 7/08

[52] U.S. Cl. ..... 173/57; 173/163; 173/73

[58] Field of Search ..... 173/163, 57, 79, 73, 173/165, 139; 175/195; 251/1.1, 1.3; 166/77.5, 78

[56] References Cited

U.S. PATENT DOCUMENTS

| | | | |
|---|---|---|---|
| 2,375,432 | 5/1945 | Miller et al. | 251/1.1 |
| 2,390,601 | 12/1945 | Maier | 173/165 |
| 3,662,842 | 5/1972 | Bromell | 166/77.5 |
| 3,736,993 | 6/1973 | West | 173/163 |
| 3,921,731 | 11/1975 | Ekwall et al. | 173/57 |
| 4,314,611 | 2/1982 | Willis | 173/163 |

*Primary Examiner*—Paul A. Bell
*Assistant Examiner*—James L. Wolfe
*Attorney, Agent, or Firm*—Willian Brinks Olds Hofer Gilson & Lione Ltd.

[57] ABSTRACT

A top head drive assembly includes a tubular quill having a central passageway aligned with an axis. The quill is supported for rotation on a load beam included in the top head drive assembly such that the quill is movable along the axis through a range of travel sufficient to provide thread protection to the down hole tubulars during tubular handling operations. Splines drivingly connect the quill with a transmission such that the transmission is operative to rotate the quill throughout the range of travel of the quill along the axis. A blowout preventer valve is mounted in an upper part of the quill to move axially and rotationally with the quill in order to eliminate sliding or rotary seals between the blowout preventer valve and the drill string.

28 Claims, 5 Drawing Sheets

FIG. 5
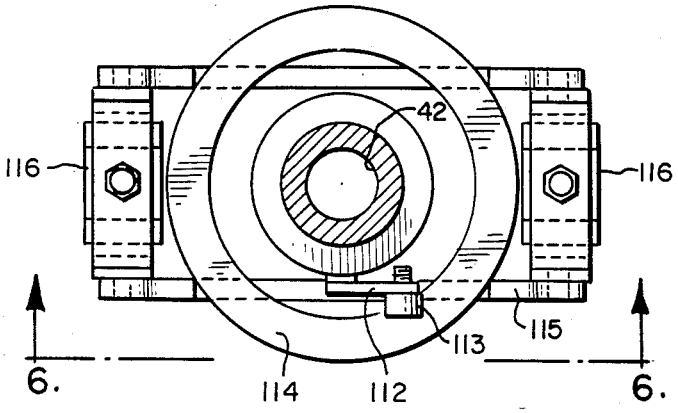
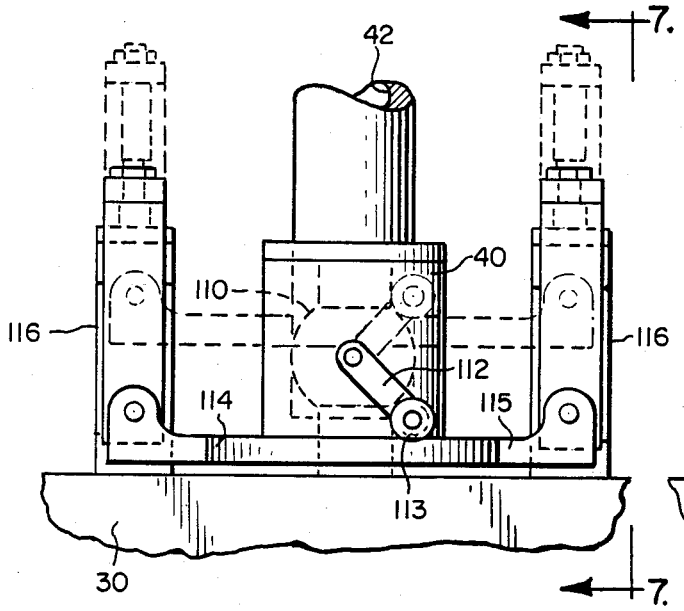
FIG. 6
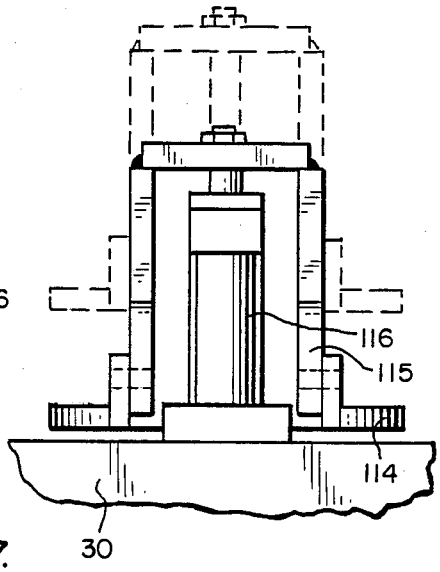
FIG. 7

TOP HEAD DRIVE ASSEMBLY WITH AXIALLY MOVABLE QUILL

BACKGROUND OF THE INVENTION

This invention relates to an axially movable quill for a top head drive assembly of the type which moves along a mast of an earth drilling machine to support and rotate a string of down hole tubulars.

An increasing number of earth drilling machines are provided with top head drive assemblies. Generally speaking, such earth drilling machines include a mast which guides the top head drive assembly for movement along the drilling axis. Typically, the top head drive assembly is supported by means of cables, and it includes means such as an electric or a hydraulic motor for rotating a quill which supports and rotates a string of down hole tubulars. U.S. Pat. No. 4,314,611 discloses one such top head drive assembly. In this application the term "down hole tubular" is intended in its broad sense to encompass the full range of tubular elements used in earth drilling and related activities, including drill pipe, drill casing and the like.

In tubular handling operations the quill or an adapter sub threadedly connected to the quill must be mated with the box end joint of a length of down hole tubular. The quill or adapter sub is lowered onto the box end joint, and then, as the quill is rotated by the top head drive assembly, a threaded connection is made up with the down hole tubular. In the event the top head drive assembly is not positioned properly, the box end joint of the down hole tubular can be damaged by excessive forces applied to the box end joint by the top head drive assembly.

In order to overcome this problem, it has been conventional practice for some time to mount a telescoping thread saver sub between the quill and the upper joint of down hole tubular. The thread saver sub is designed to telescope through a predetermined range of travel in response to compressive forces. The thread saver sub acts to limit the forces that can be applied by the top head drive assembly to the down hole tubular, at least until the range of travel of the thread saver sub is exhausted.

Though conventional thread saver subs can operate to protect the threads of the down hole tubular from damage, they suffer from the disadvantage of potential catastrophic failure in a blowout. If the drilling mud rises in the bore hole during a drilling or casing operation, large pressures can be applied to the seals of the thread saver sub. Any failure of these seals can cause the thread saver sub to fail catastrophically.

The present invention is directed to improvements to a top head drive assembly which largely overcome these disadvantages by mounting the quill itself for axial movement in the top head drive assembly.

SUMMARY OF THE INVENTION

According to this invention, a top head drive assembly of the type comprising a load beam, means for guiding the load beam along a mast of an earth drilling machine, and means for rotating an output member supported on the load beam is provided with a tubular quill having a central passageway aligned with an axis. The quill operates to support a string of down hole tubulars and the quill is supported for rotation on the load beam such that the quill is movable along the axis through a range of travel sufficient to provide thread protection to the down hole tubulars during tubular handling operations. Spline means drivingly connect the output member to the quill such that the rotating means is operative to rotate the quill throughout the range of travel of the quill along the axis.

As pointed out in detail in connection with the preferred embodiment described below, the axially movable quill of this invention provides a number of important advantages. First, it provides thread protection to down hole tubulars during tubular handling operations. In the event the top head drive assembly is lowered so as to apply excessive forces to a down hole tubular, the quill moves upwardly in the top head drive assembly. In this way the threads of the tubular are protected from the full weight of the top head drive assembly. In the preferred embodiment described below, an upper blowout preventer valve is mounted in the upper end of the quill to move axially with the quill, and a lower blowout preventer valve is threadedly mounted in the string below the quill so as to move axially with the quill. With this arrangement, there are no sliding or rotary seals between either of the blowout preventer valves and the string. In this way, the possibility for catastrophic failure at a seal is entirely eliminated. Furthermore, the placement of a blowout preventer valve at the top of the quill, above the load beam, simplifies remote control of the blowout preventer valve. The embodiment described below is provided with a valve actuator which allows the valve to be closed remotely simply by positioning the actuator properly.

The arrangement described below provides further advantages in that the top head drive assembly has a much more compact overall length. This results in a reduced height of the mast and a general reduction in the size, cost and weight of the drilling machine.

The invention itself, together with further objects and attendant advantages, will best be understood by reference to the following detailed description, taken in conjunction with the accompanying drawings.

BRIEF DESCRIPTION OF THE DRAWINGS

FIG. 5 is a section taken along line 5—5 of FIG. 1 showing the upper blowout preventer valve and the actuator for this valve.

FIG. 6 is a front elevational view taken along line 6—6 of FIG. 5.

FIG. 7 is a side elevational view taken along line 7—7 of FIG. 6.

DETAILED DESCRIPTION OF THE PRESENTLY PREFERRED EMBODIMENTS

Figure 1:
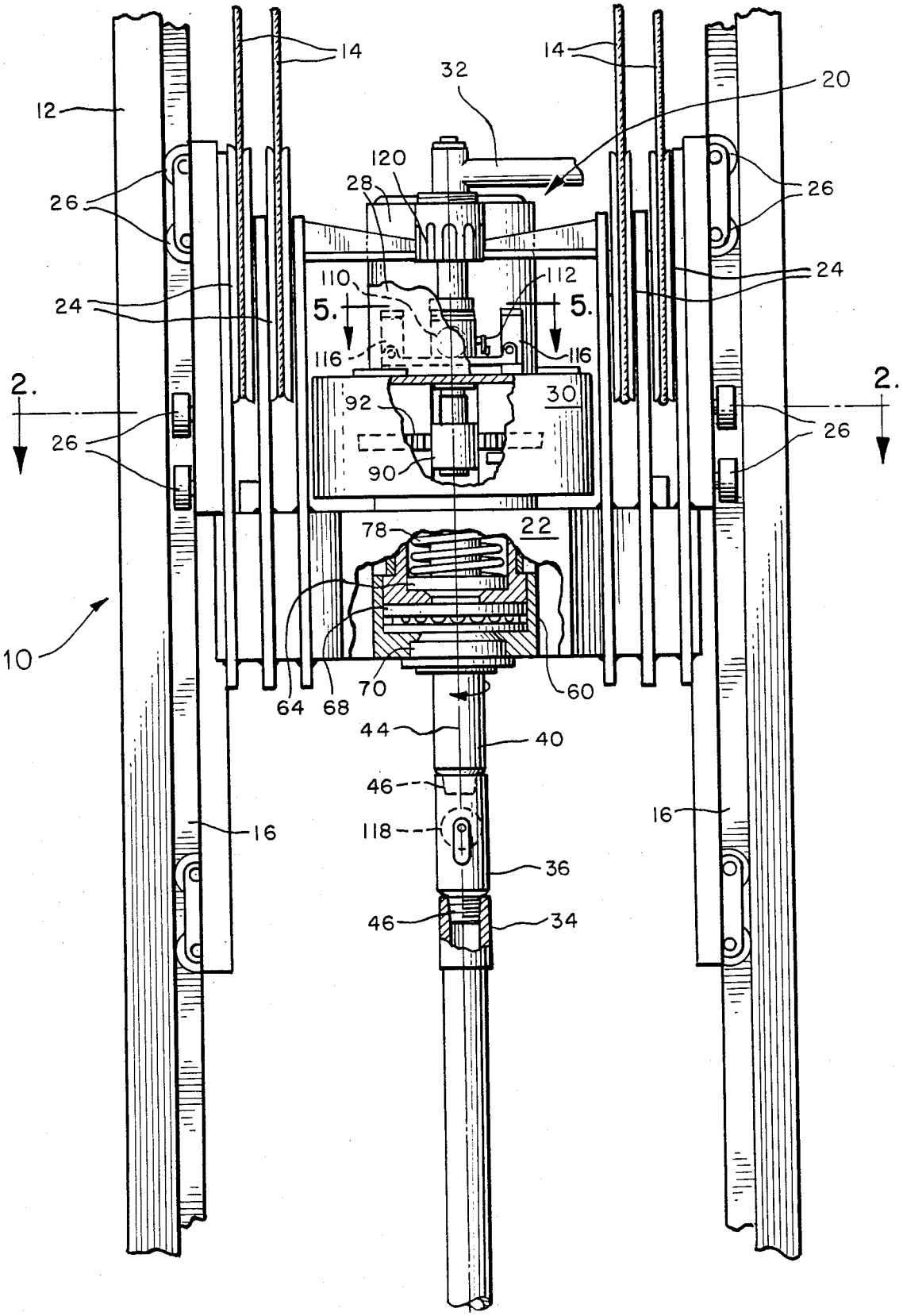
FIG. 1 is an elevational view of a top head drive assembly which incorporates a presently preferred embodiment of this invention.

Turning now to the drawings, FIG. 1 shows a side elevation of a portion of an earth drilling machine 10.

This earth drilling machine 10 includes a mast 12 which defines a pair of opposed guide rails 16. A draw works (not shown) controls the position of a cable 14 that is used to raise and lower a top head drive assembly 20. The top head drive assembly 20 includes a load beam 22 which is guided along the mast 12 by guide rollers 26 which engage the guide rails 16. A set of sheaves 24 suspend the top head drive assembly 20 from the cable 14.

The top head drive assembly 20 includes a pair of motors 28 which in this embodiment are each DC electric, shunt wound motors. The motors 28 power a speed reduction transmission 30. Drilling mud is supplied to the top head drive assembly 20 by means of a mud supply pipe 32, and the top head drive assembly 20 supports a string of down hole tubulars such as drill pipe 34. In the conventional manner a blowout preventer sub 36 is threadedly connected to the upper end of the string of drill pipe 34, and this sub 36 is in turn connected to the top head drive assembly 20.

The foregoing details of the drilling machine 10 are conventional, and form no part of this invention. For example, the top head drive assembly described in U.S. Pat. No. 4,314,611 incorporates most of the features described above. Further details of the preferred top head drive assembly are set out in copending U.S. patent applications Ser. Nos. 07/034,481 and 07/035,021, assigned to the assignee of the present invention. The top head drive assembly 20 has been described merely to define the environment of this invention, and will therefore not be described in greater detail here.

Figure 4:
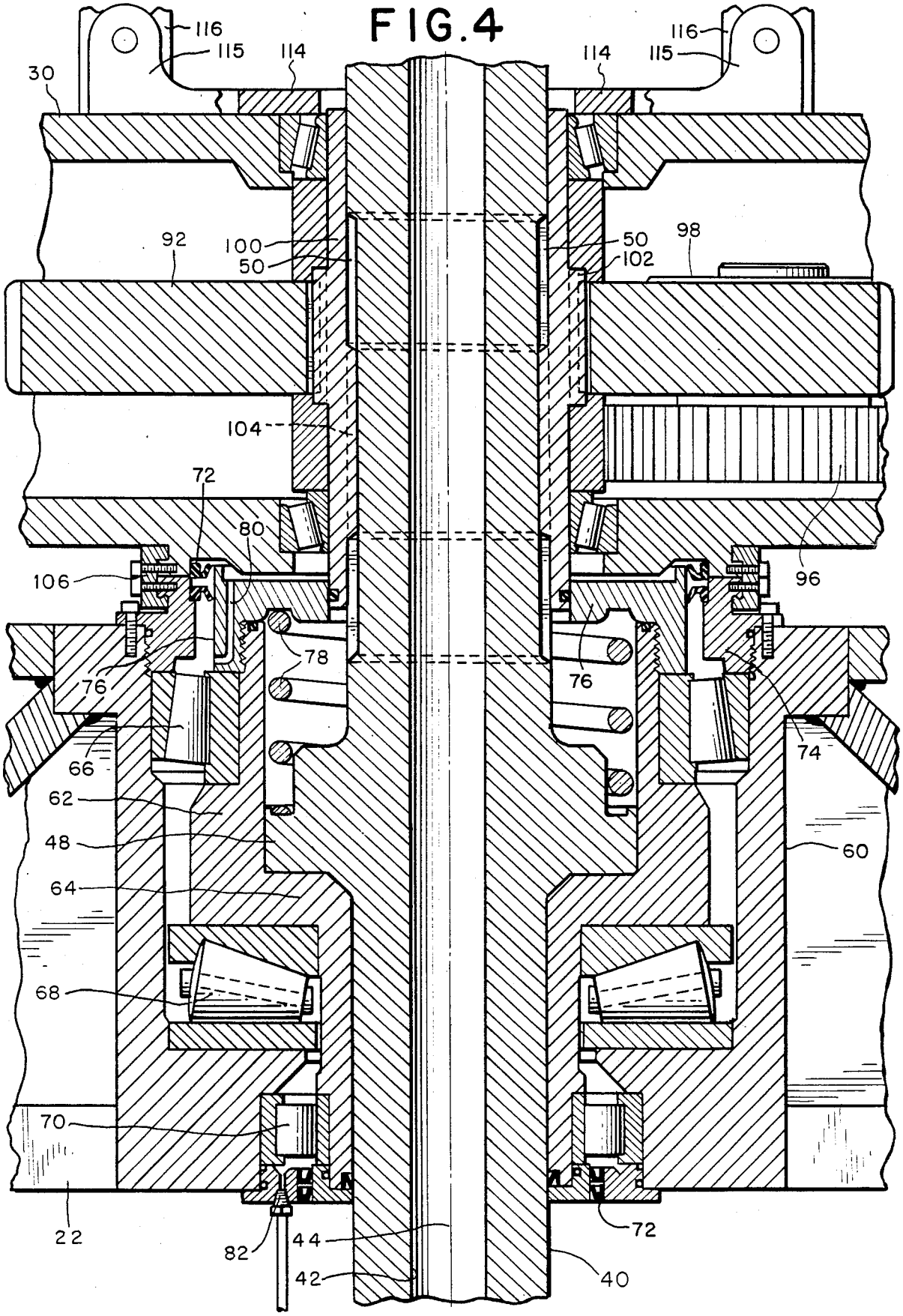
FIG. 4 is a cross-sectional view taken along line 4—4 of FIG. 2.

According to this preferred embodiment of this invention, the top head drive assembly 20 includes a tubular quill 40 (FIGS. 1 and 4). The quill 40 defines a central passageway 42 extending from the upper to the lower end of the quill 40. This passageway 42 is centered about an axis 44 which forms the drilling axis of the top head drive assembly 20. A set of lower threads 46 is formed on the lower end of the quill 40, and these threads are adapted to engage and support the string of drill pipe 34 by means of the sub 36. The quill 40 also defines an outer annular shoulder 48, a set of outer splines 50, and a set of upper threads 52, all as shown in FIGS. 4 and 7.

In this embodiment a cylindrical support bowl 60 is rigidly secured to the load beam 22, and operates to support a load tube 62 for rotation in the load beam 22 (FIG. 4). This load tube 62 is tubular and defines an inner annular shoulder 64. Three bearings 66, 68, 70 guide the rotational movement of the load tube 62 with respect to the support bowl 60. The lower bearing 70 is a radial alignment bearing. The center bearing 68 is a load thrust bearing, and the upper bearing 66 provides upper radial alignment as well as a pre-load for the thrust bearing 68. A thrust pre-load nut 74 is threadedly connected to the support bowl 60 so as to pre-load the bearings 66, 68.

As shown in FIG. 4 the quill 40 is positioned inside the load tube 82, with the outer shoulder 48 of the quill 40 resting on the inner shoulder 64 of the load tube 62. A quill damper spring 78 bears against the upper side of the outer shoulder 48, and this spring 78 is held in place by a spring retainer 76 which is threadedly secured to the load tube 62. Lubricating oil enters the region between the support bowl 60 and the load tube 62 by means of an upper oil passage 80, and oil is removed to a pump and filter via a lower oil passage 82. Oil seals 72 contain lubricating oil in the region between the support bowl 60 and the load tube 62.

It is important to note in FIG. 4 that the quill 40 is mounted for limited movement along the direction of the axis 44. By compressing the spring 78 the quill 40 can move upwardly as shown in FIG. 4, toward the mud supply pipe 32. The working stroke of the quill 40 should be long enough to provide effective protection to the threads of the drill pipe 34. In this embodiment, the working stroke of the quill 40 with respect to the load tube 62 is over 5 inches. The spring should be dimensioned to damp movement of the quill 40 in the load tube 62, and can for example have a spring rate of 125 pounds per inch.

Figure 2:
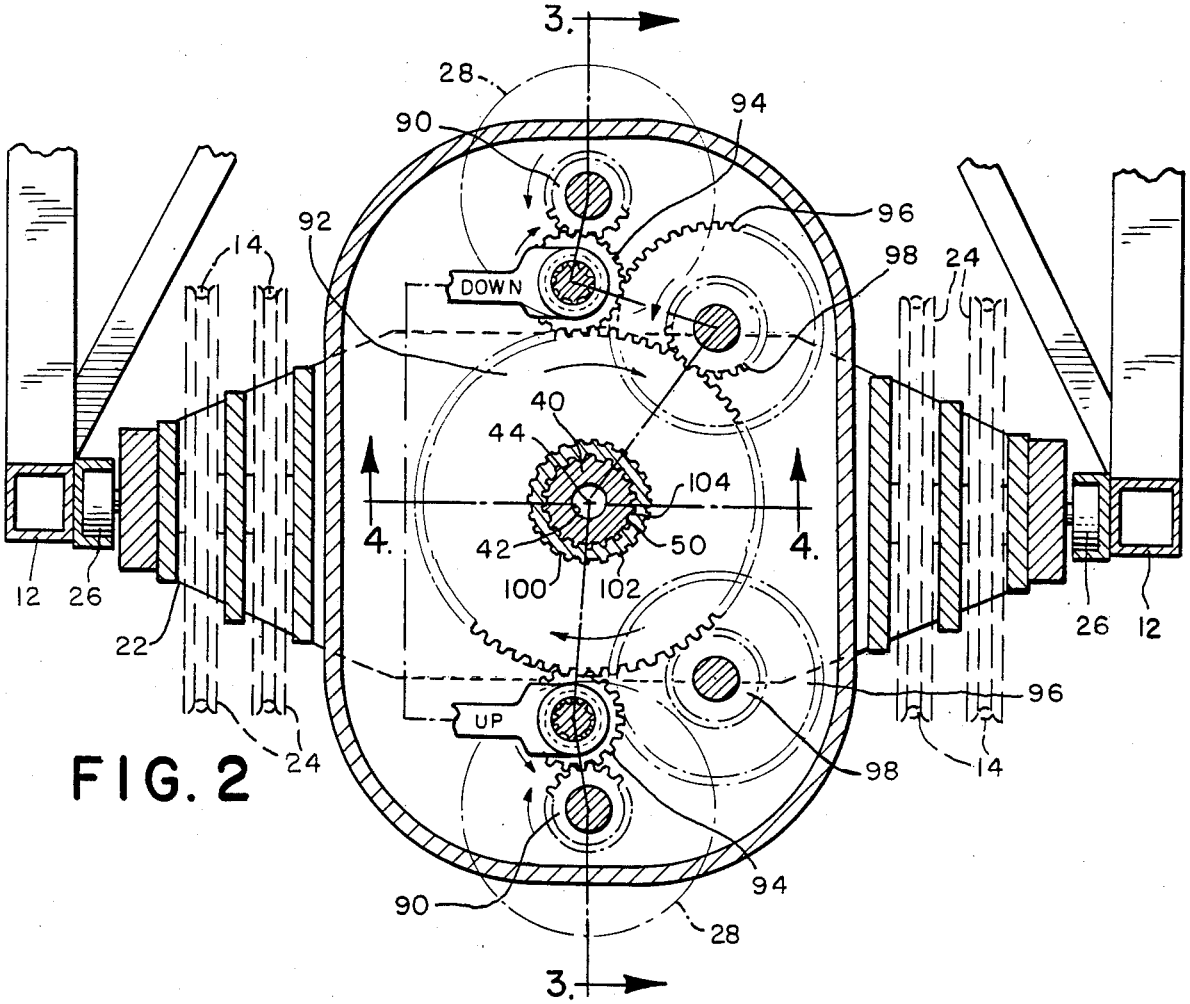
FIG. 2 is a cross-sectional view taken along line 2—2 of FIG. 1.
Figure 3:
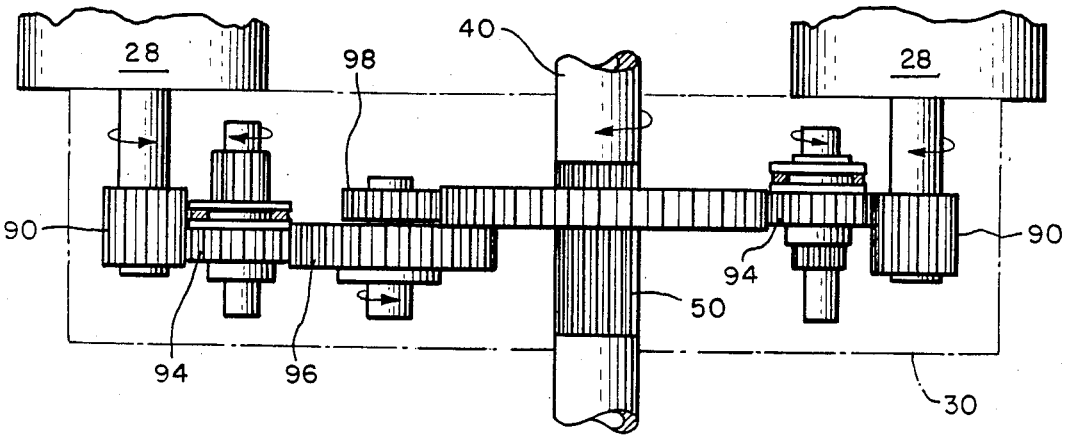
FIG. 3 is a cross-sectional view taken along line 3—3 of FIG. 2.

As shown in FIG. 4, the transmission 30 is mounted to the upper end of the support bowl 60 by means of a clamp ring 106 which is bolted in place. FIGS. 2 and 3 provide two views of the gears of the transmission 30. As shown in FIG. 2 the top head drive assembly includes two electric motors 28, each of which is provided with a motor pinion gear 90, A bull gear 92 rotates about an axis centered on the quill 40, and two sets of shifter pinions 94 and reduction gears 96, 98 are provided. When operating in the low speed mode, as shown on the left of FIG. 3, the shifter pinions 94 are lowered to engage the motor pinion gears 90 with the large reduction gear 96. Each of the large reduction gears 96 is keyed to the respective small reduction gear 98, which in turn meshes with the bull gear 92. For high speed operation the shifter pinions 94 are shifted to engage the motor pinion gears 90 directly with the bull gear 92, as shown on the right of FIG. 3.

As best shown in FIGS. 2 and 4, the bull gear 92 defines an array of internal teeth shaped to mate with outer gear teeth 102 formed on a drive tube 100. This drive tube 100 defines a set of inner splines 104 which are shaped to mate with the set of outer splines 50 of the quill 40. The outer splines 50 are dimensioned such that the drive tube 100 maintains the bull gear 92 in driving engagement with the quill 40 throughout the entire range of travel of the quill 40 with respect to the load tube 62. In alternate embodiments the drive tube 100 can be eliminated and the bull gear can engage the splines of the quill 40 directly.

As best shown in FIGS. 5–8, an upper blowout preventer valve 110 is mounted in the upper end of the quill 40. This valve 110 can be a conventional ball valve for example. The valve 110 operates either to open or to close the central passageway 42, and the position of the valve 110 is controlled by a handle 112. In alternate embodiments, the upper blowout preventer valve can be threaded to the upper end of the quill 40 to move axially with the quill 40.

Means are provided for remotely controlling the upper valve 110. As shown in FIGS. 5–7, the handle 112 of the valve 10 supports a follower 113 which is positioned directly over an actuator ring 114. This ring is in turn supported for axial movement by a frame 115 which is mounted between two hydraulic cylinders 116. The cylinders 116 move the frame 115 between a lower position, as shown in solid lines in FIGS. 6 and 7, and an upper position, as shown in dashed lines in FIGS. 6 and 7. In the lower position the valve 110 is in the open position, and in the upper position the valve 110 seals the central passageway 42. The frame 115 is normally positioned in the lower position during drilling operations. In the event of a threat of a blowout, the cylinders 116 are used to raise the frame 115, thereby moving the handle 112 to close the valve 110.

This embodiment also includes a lower blowout preventer valve 118 which is mounted beneath the quill 40 to move axially and rotationally with the quill 40. For example, the lower blowout preventer valve 118 can be threaded directly to the quill 40 as shown in FIG. 1. The valve 118 can be a conventional kelly valve for example, such as those distributed by OMSCO.

It is important to note that both the upper and lower blowout preventer valves 110, 118 rotate and move axially with the quill 40. Thus, no sliding or rotary seals are required between either of the blowout preventer valves 110, 118 and the string of drill pipe 34.

Figure 8:
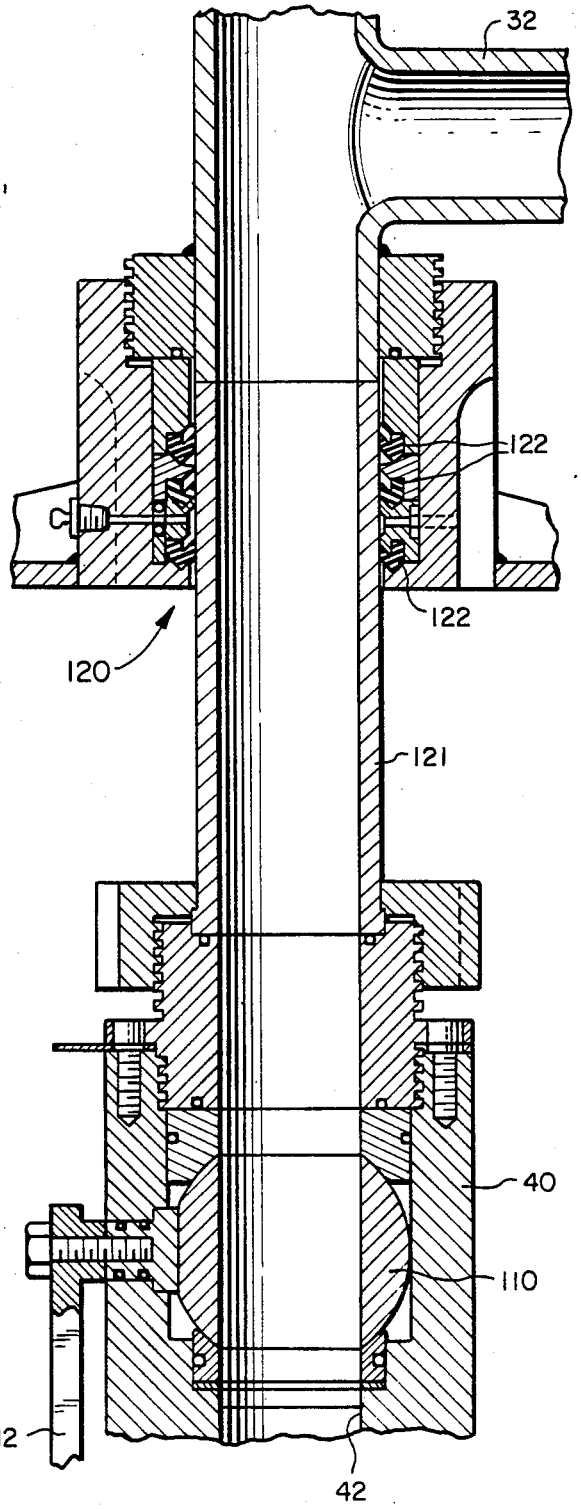
FIG. 8 is a cross-sectional view of the upper blowout preventer valve and the rotary seal of the embodiment of FIG. 1.

The upper end of the quill 40 is threadedly coupled to a wash pipe 121 which is in turn coupled to the mud pipe 32 by means of a seal 120 (FIG. 8). This seal 120 includes sealing elements 122 arranged to allow both rotary and axial movement of the wash pipe 121 with respect to the mud pipe 32. In this way the seal 120 accommodates axial movement of the quill 40.

The mud seal 120, which is required in any case to accommodate rotary movement of the quill 40, can readily be adapted to accommodate axial movement of the quill 40 as well. In this way, the total number of seals is minimized.

Figure 9:
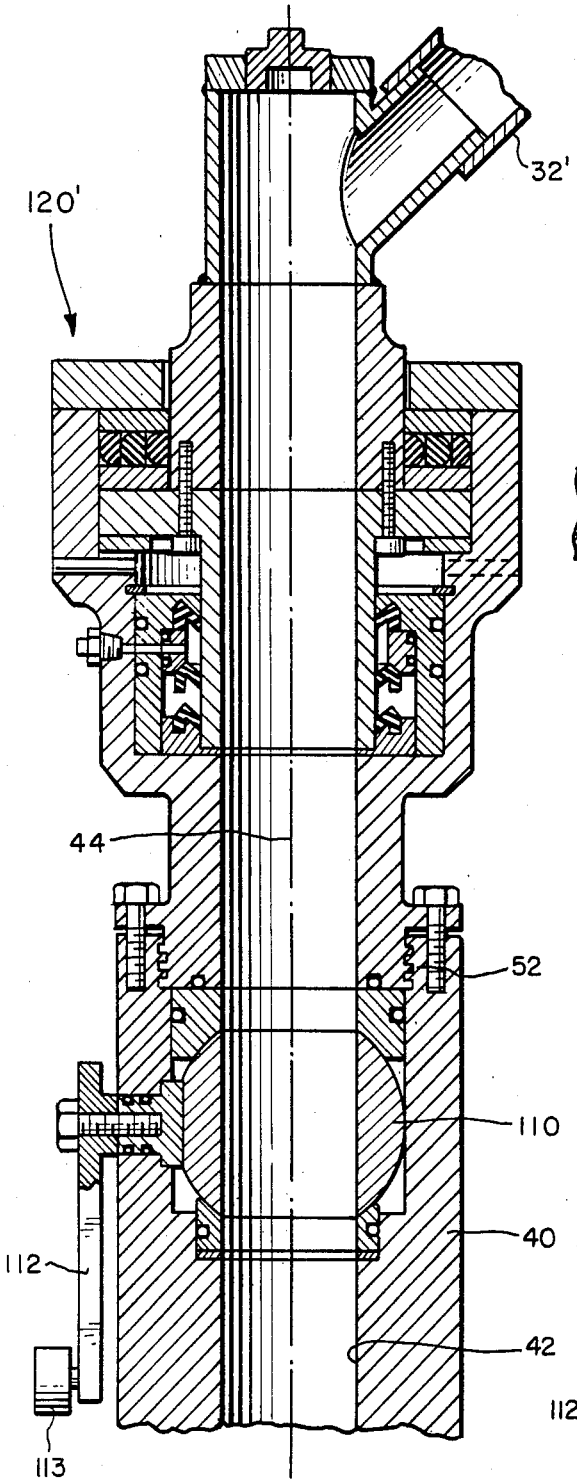
FIG. 9 is a cross-sectional view of an alternative embodiment of the seal of FIG. 8.

In an alternate embodiment (FIG. 9), upper end of the upper blowout preventer valve 110 is connected to a mud supply pipe 32' by means of a mud seal 120'. This mud seal 120' can be of the conventional type which allows only rotary motion between the mud supply pipe 32' and the upper end of the quill 40. In the event such a conventional mud seal is used, the mud supply pipe 32' should preferably be of the flexible type to accommodate axial movement of the quill 40.

From the foregoing description it should be apparent that the preferred embodiment described above provides important advantages in operation. In particular, when the top head drive assembly 20 is lowered to make a threaded connection with a length of down hole tubular, the axially movable quill 40 prevents excessive loads from being applied to the down hole tubular. To the extent necessary, the quill 40 is free to move upwardly with respect to the load tube 62, the support bowl 60, and the load beam 22. Because of the relatively small mass of the quill 40 and the relatively low spring constant of the spring 78, excessive loads on the down hole tubular can be substantially eliminated.

This advantage is obtained while providing excellent security against blowouts. In particular, there are no sliding or rotary seals between either of the blowout preventer valves 110, 118 and the string of drill pipe 34. Thus, there are no seals to fail in the event of a blowout. Finally, as pointed out above the placement of the upper blowout preventer valve 110 allows the use of the system described above to provide automatic control over the valve 110. All of these advantages are provided by a top head drive assembly which is compacted in overall length. This compactness reduces the overall height of the mast and therefore the size and weight of the drilling machine.

Of course, it should be understood that a wide range of changes and modifications can be made to the preferred embodiment described above. For example, the axially moving quill of this invention can be adapted for a wide range of load beams, transmissions, motors, and the like. It is not essential in all applications that the blowout preventer valves be installed on the quill as described above, in the event there is no need to guard against a blowout. Furthermore, the details of construction and design described above can readily be adapted for particular applications. It is therefore intended that the foregoing detailed description be regarded as illustrative rather than limiting and that it be understood that it is the following claims, including all equivalents, which are intended to define the scope of this invention.

We claim:

1. In a top head drive assembly of the type comprising a string support structure, means for guiding the string support structure along a mast of an earth drilling machine, and means for rotating an output member supported on the string support structure, the improvement comprising:

a tubular quill having a central passageway aligned with an axis;

means for supporting a string of down hole tubulars from the quill;

means for supporting the quill for rotation on the string support structure such that the quill is movable along the axis through a selected non zero range of travel to provide thread protection to the down hole tubulars during tubular handling operations; and spline means for drivingly connecting the output member to the quill such that the rotating means is operative to rotate the quill throughout the range of travel of the quill along the axis;

said quill having an upper portion which extends upwardly from the spline means and the output member, said upper portion configured and positioned accessibly for mounting additional components above the spline means and the output member to move axially with the quill.

2. The invention of claim 1 wherein the means for supporting the string of down hole tubulars comprises a set of threads formed on a lower end portion of the quill.

3. The invention of claim 1 further comprising means for biasing the quill downwardly with respect to the string support structure.

4. The invention of claim 3 wherein the biasing means comprises a coil spring which surrounds the quill and reacts against the quill.

5. The invention of claim 1 further comprising:

a blowout preventer valve mounted into the upper portion of the quill to selectively close and open the central passageway, said valve mounted to the quill to move axially and rotationally with the quill and with the string of down hole tubulars.

6. The invention of claim 5 further comprising:

an additional blowout preventer valve threadedly mounted beneath a lower end of the quill to selectively close and open the central passageway, said additional valve mounted to move axially and rotationally with the quill and with the string of down hole tubulars.

7. The invention of claim 5 further comprising:

a handle coupled to the valve to open and close the valve;

a handle actuator mounted to travel with the string support structure, said actuator movable between a first position, in which the actuator remains out of contact with the handle, and a second position, in which the actuator moves the handle to close the valve.

8. The invention of claim 1 wherein the range of travel is not less than about five inches.

9. The invention of claim 1 further comprising:

a blowout preventer valve for selectively opening and closing the central passageway, said valve mounted to the quill to move axially and rotationally with the quill and with the string of down hole tubulars, without any rotary or sliding seals between the blowout preventer valve and the quill.

10. The invention of claim 4 further comprising:

a drilling mud supply pipe;

means for coupling the drilling mud supply pipe to the upper portion of the quill above the blowout preventer valve; and means, included in the coupling means, for providing a seal to accomodate rotary movement of the quill with respect to the drilling mud supply pipe while preventing axial movement therebetween.

11. The invention of claim 1 wherein the quill is configured to extend above and below the string support structure.

12. The invention of claim 1 wherein the quill is a one piece, integral element.

13. In a top head drive assembly of the type comprising a string support structure, means for guiding the string support structure along a mast of an earth drilling machine, and means for rotating an output member supported on the string support structure, the improvement comprising:

a tubular quill which defines an outer annular shoulder, an upper set of splines, a central passageway extending along an axis, and a lower set of threads adapted to support a string of down hole tubulars from the quill;

a load tube seized to receive the quill, said load tube defining a quill support shoulder configured to mate with the shoulder of the quill to support the quill against downward movement along the axis.

a spring interposed between the load tube and the quill to bias the quill shoulder against the quill support shoulder while allowing the quill to move upwardly along the axis through a selected non zero range of travel to provide thread protection to the down hole tubulars during tubular handling operations;

means for supporting the load tube for rotation in the string support structure; and means for drivingly interconnecting the upper set of splines with the output member such that the rotation means is operative to rotate the quill throughout the range of travel of the quill along the axis;

said quill having an upper part that extends above the output member and a lower part that extends below the load tube such that the upper part of the quill moves axially and rotationally with the string of down hole tubulars and the upper part of the quill is accessible for mounting additional components to move axially with the quill.

14. The invention of claim 13 wherein the drivingly interconnecting means comprises a drive tube having an outer set of gear teeth shaped to engage the output member and an inner set of splines shaped to engage the upper set of spines of the quill.

15. The invention of claim 13 further comprising:

a blowout preventer valve mounted into the upper portion of the quill to selectively close and open the central passageway, said valve mounted to the quill to move axially and rotationally with the quill and with the string of down hole tubulars.

16. The invention of claim 15 further comprising:

an additional blowout preventer valve threadedly mounted beneath a lower end of the quill to selectively close and open the central passageway, said additional valve mounted to move axially and rotationally with the quill and with the string of down hole tubulars.

17. The invention of claim 15 further comprising:

a handle coupled to the valve to open and close the valve;

a handle actuator mounted to travel with the string support structure, said actuator movable between a first position, in which the actuator remains out of contact with the handle, and a second position, in which the actuator moves the handle to close the valve.

18. The invention of claim 13 further comprising:

a drilling mud supply pipe;

means for coupling the drilling mud supply pipe to the upper part of the quill; and means, included in the coupling means, for providing a seal to accomodate rotary movement of the quill with respect to the drilling mud supply pipe while preventing axial movement therebetween.

19. The invention of claim 13 wherein the range of travel is not less than about five inches.

20. The invention of claim 13 further comprising:

a blowout preventer valve for selectively opening and closing the central passageway, said valve mounted to the quill to move axially and rotationally with the quill and with the string of down hole tubulars, without any rotary or sliding seals between the blowout preventer valve and the quill.

21. The invention of claim 13 wherein the quill is configured to extend above and below the string support structure.

22. The invention of claim 21 wherein the quill is a one piece, integral element.

23. In a top head drive assembly of the type comprising a string support structure, means for guiding the string support structure along a mast of an earth drilling machine, and means for rotating an output member supported on the string support structure, the improvement comprising:

a support bowl rigidly secured to the string support structure;

a load tube which defines an inner shoulder;

a plurality of bearings interposed between the support bowl and the load tube to support the load tube for rotation in the support bowl;

a quill mounted for motion along an axis in the load tube, said quill defining an outer shoulder shaped to engage and the supported by an inner shoulder defined by the load tube, a set of lower threads adapted to support a string of down hole tubulars, a central passageway aligned with the axis, and an outer set of splines, said quill movable along the axis through a selected non zero range of travel to provide thread protection to the down hole tubulars during tubular handling operations, said outer set of splines configured to mate with the output member to transmit rotary power from the output member to the quill throughout the entire range of travel of the quill;

a coil spring disposed around the quill to bias the quill downwardly with respect to the load tube; and an upper blowout preventer valve mounted directly within an upper end of the quill and operative to selectively close and open the central passageway, said valve mounted to the quill to move axially and rotationally with the quill.

24. The invention of claim 1 further comprising:

an additional blowout preventer valve threadedly mounted beneath a lower end of the quill to selectively close and open the central passageway, said additional valve mounted to move axially and rotationally with the quill and with the string of down hole tubulars.

25. The invention of claim 23 further comprising:

a handle coupled to the valve to open and close the valve;

a handle actuator mounted to travel with the string support structure, said actuator movable between a first position, in which the actuator remains out of contact with the handle, and a second position, in which the actuator moves the handle to close the valve.

26. The invention of claim 1 wherein the handle actuator comprises:

a ring positioned to bear on the handle;

a frame secured to the ring to support the ring; and a pair of hydraulic cylinders, each mounted to the ring so as to move the ring between the first and second positions.

27. The invention of claim 23 further comprising:

a drilling mud supply pipe;

means for coupling the drilling mud supply pipe to an upper end portion of the quill; and means, included in the coupling means, for providing a seal to accomodate rotary movement of the quill with respect to the drilling mud supply pipe while preventing axial movement therebetween.

28. The invention of claim 23 wherein the range of travel is not less than about 5 inches.

* * * * *

UNITED STATES PATENT AND TRADEMARK OFFICE

CERTIFICATE OF CORRECTION

PATENT NO. : 4,815,546

DATED : March 28, 1989

INVENTOR(S) : Keith M. Haney et al.

It is certified that error appears in the above-identified patent and that said Letters Patent is hereby corrected as shown below:

In column 4, line 21, after "90" please delete "," and substitute therefor --.--.

In column 4, line 56, please delete "10" and substitute therefor --110--.

IN THE CLAIMS

In column 7, line 35, please delete "seized" and substitute therefor --sized--.

Signed and Sealed this

Eighth Day of October, 1991

*Attest:*

*Attesting Officer*

HARRY F. MANBECK, JR.

*Commissioner of Patents and Trademarks*